US007280789B2

(12) United States Patent
Iwasaki

(10) Patent No.: US 7,280,789 B2
(45) Date of Patent: Oct. 9, 2007

(54) IMAGE FORMING AND REPRODUCING APPARATUS, AND IMAGE TRANSFERRING METHOD FOR CONTROLLING ROTATION SPEEDS OF IMAGE CARRIERS

(75) Inventor: Hiroyuki Iwasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 194 days.

(21) Appl. No.: 11/169,676

(22) Filed: Jun. 30, 2005

(65) Prior Publication Data

US 2006/0002745 A1 Jan. 5, 2006

(30) Foreign Application Priority Data

Jul. 1, 2004 (JP) ..... 2004-195493
Jun. 7, 2005 (JP) ..... 2005-166978

(51) Int. Cl.
*G03G 15/01* (2006.01)

(52) U.S. Cl. ..... 399/299; 399/301

(58) Field of Classification Search ..... 399/299, 399/301; 347/116

See application file for complete search history.

(56) References Cited

U.S. PATENT DOCUMENTS 5,412,302 A * 5/1995 Kido et al.
5,893,017 A * 4/1999 Yamamoto ..... 399/299
6,070,041 A 5/2000 Nakayasu et al.
6,118,963 A 9/2000 Fujikura et al.
7,174,237 B2 * 2/2007 Takayama et al.
2004/0197111 A1 10/2004 Kuroda

FOREIGN PATENT DOCUMENTS

EP 0 816 930 A2 1/1998
EP 0 840 174 A2 5/1998
EP 0 999 479 A2 5/2000
EP 1 031 887 A2 8/2000
JP 11119506 A * 4/1999
JP 2000-250285 9/2000
JP 2000-315567 11/2000

* cited by examiner

*Primary Examiner*—Susan S. Lee
(74) *Attorney, Agent, or Firm*—Oblon, Spivak, McClelland, Maier & Neustadt, P.C.

(57) ABSTRACT

An image forming and reproducing apparatus is configured to transfer images formed on multiple rotatable image carriers (1Y, 1C, 1M, and 1B) onto a transfer member (3) at associated transfer positions (P1-P4). The apparatus includes a rotation speed controller that controls the rotation speeds of the image carriers such that times required for the images formed at exposure positions of the image carriers to reach the associated transfer positions agree with each other among the image carriers when superposing the images one on the other on the transfer member.

21 Claims, 10 Drawing Sheets

| MOTOR CONTROLLER | ANGULAR VELOCITY |
|---|---|
| 1Y | ωy |
| 1C | ωc |
| 1M | ωm |
| | |

IMAGE FORMING AND REPRODUCING APPARATUS, AND IMAGE TRANSFERRING METHOD FOR CONTROLLING ROTATION SPEEDS OF IMAGE CARRIERS

BACKGROUND OF THE INVENTION

1. Field of the Invention

The present invention relates to an image forming and reproducing apparatus and an image transferring method, and more particularly, to an image forming and reproducing apparatus with independently rotated image carriers on which images of different colors are to be formed, as well as to an image transferring technique used in such an image forming and reproducing apparatus.

2. Description of Related Art

Conventionally, color image forming and reproducing apparatuses are known. In such an apparatus, different color images (such as black, yellow, magenta, and cyan images) are formed separately on associated photosensitive drums or image carriers which serve as image carriers and are rotated independently by driving motors and serving as image carriers. The color images formed on the photosensitive drums are transferred onto an intermediate transfer belt.

Conventionally, such an image forming and reproducing apparatus is provided with rotational phase detecting means for detecting rotation phases of the photosensitive drums independently driven by multiple driving motors, together with phase difference calculation means for calculating a rotational phase difference between the reference phase and the detected rotation phase of each photosensitive drum. The rotation phase of each photosensitive drum is corrected based on the associated rotational phase difference. See, for example, JP 2000-250285A (Publication 1).

The image forming and reproducing apparatus disclosed in Publication 1 is designed so as to correct rotational phase differences among multiple photosensitive drums if there are such phase differences detected. This arrangement allows four different color images, e.g., black, yellow, magenta and cyan images, to be superposed on each other without misalignment. However, since the phase difference has to be corrected every time a rotational phase difference is produced, the operationability and the functionality are degraded.

In order to detect rotation phases of multiple photosensitive drums, a reference pattern, also named a registration pattern, has to be formed on each of the photosensitive drums prior to actual image formation to detect misalignment among different color images. The rotational phase difference between photosensitive drums is corrected based on the amount of misalignment among color images. This means that the actual image forming and reproducing operation is delayed every time misalignment correction is carried out.

In general, misalignment of color images formed by different photosensitive drums and superposed on each other to form a combined image is often caused by error in distance between photosensitive drums, as well as in machining and assembling accuracy of components used in the image writing unit.

Once such an error is corrected at the beginning of using the image forming and reproducing apparatus, it does not greatly change until the photosensitive drums and image writing unit are removed for maintenance.

In the conventional image misalignment correction, the registration position is adjusted dot by dot to shift the image position to the correction position in the image transfer unit.

Since the image misalignment is corrected on the dot basis, subtle offset of images within a dot cannot be corrected although such minute offset is likely to affect evenness of color and delicate hue.

SUMMARY OF THE INVENTION

The present invention was conceived in view of the above-described problems, and it is an object of the invention to provide an image forming and reproducing apparatus and an image transferring method that can improve the correction accuracy for image misalignment, while reducing time required for the correction for image misalignment.

To achieve the object, in one aspect of the invention, an image forming and reproducing apparatus configured to transfer images formed on a plurality of rotatable image carriers onto a transfer member at associated transfer positions is provided. The apparatus includes a rotation speed controller configured to control rotation speeds of the image carriers such that time required for the images formed at exposure positions of the image carriers to reach the associated transfer positions agree with each other among the image carriers when superposing the images on each other on the transfer member.

In another aspect of the invention, an image transferring method for transferring images formed on a plurality of image carriers at associated transfer position onto a transfer member is provided. The method includes the steps of:

(a) acquiring rotation speed information for the image carriers, the rotation speed information being configured so as to bring time required for the images formed at exposure positions on the image carriers to reach the transfer positions in agreement with each other among image carriers; and (b) controlling the rotation speeds of the image carriers based on the rotation speed information.

In this manner, the rotation speeds of the image carriers are controlled such that such that time required for the images formed at the exposure positions of the image carriers to reach the associated transfer positions agree with each other among the image carriers.

Accordingly, even if misalignment occurs in the superposed images due to error in distance between image carriers or error in component precision or assembling accuracy of the image writing system, the image misalignment can be appropriately corrected under control of the rotation speeds of the image carriers so as to bring time required for the images on the image carriers to reach the transferred positions in agreement with each other.

Image misalignment caused by error in distance between image carriers or error in component precision or assembling accuracy of the image writing system is unlikely to greatly vary until the image carriers or the image writing system is detached for maintenance or other reasons. Accordingly, the rotation speeds of the image carriers are set when, for example, the apparatus is powered on, and consequently, image misalignment correcting time can be reduced.

The image misalignment correction technique of the present invention is distinguished from the conventional dot-by-dot based correction for image misalignment performed when images are formed on image carriers (photosensitive drums). With the present invention, image misalignment is corrected by bringing time required for the images formed at the exposure positions of the image carriers to reach the transfer positions in agreement with each other among the image carriers. Consequently, subtle deviation of each color image within a dot can be corrected according to the resolution of the rotation speed of the image carrier.

The precision of misalignment correction can be improved, while time required for the correction for image misalignment can be reduced.

BRIEF DESCRIPTION OF THE DRAWINGS

Other objects, features, and advantages of the invention will become more apparent from the following detailed description when read in conjunction with the accompanying drawings, in which.

DETAINED DESCRIPTION OF THE PREFERRED EMBODIMENTS

The preferred embodiments of the present invention are now described below, in conjunction with the attached drawings.

Figure 1:
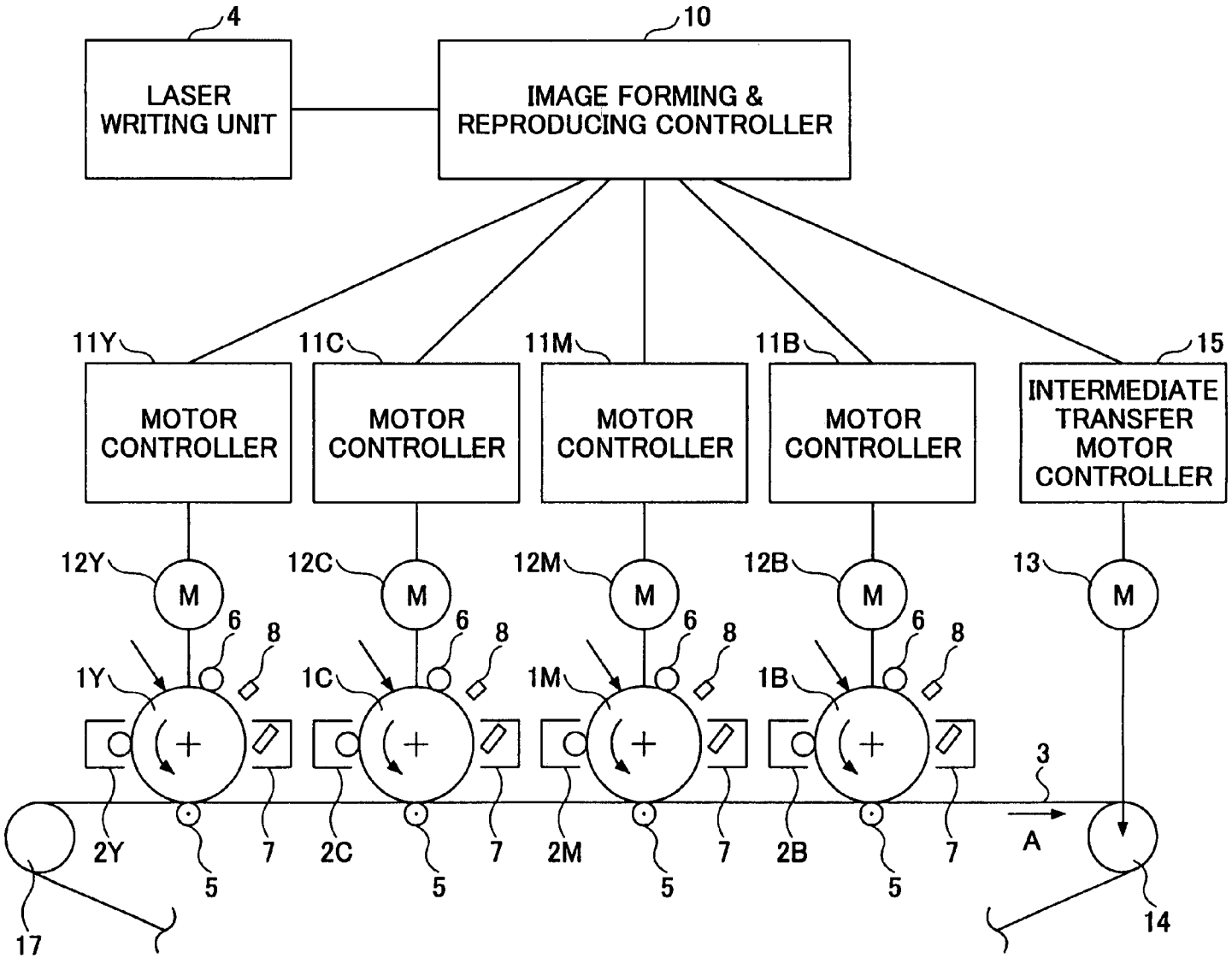
FIG. 1 is a block diagram of the control system of an image forming and reproducing apparatus according to an embodiment of the invention.
Figure 2:
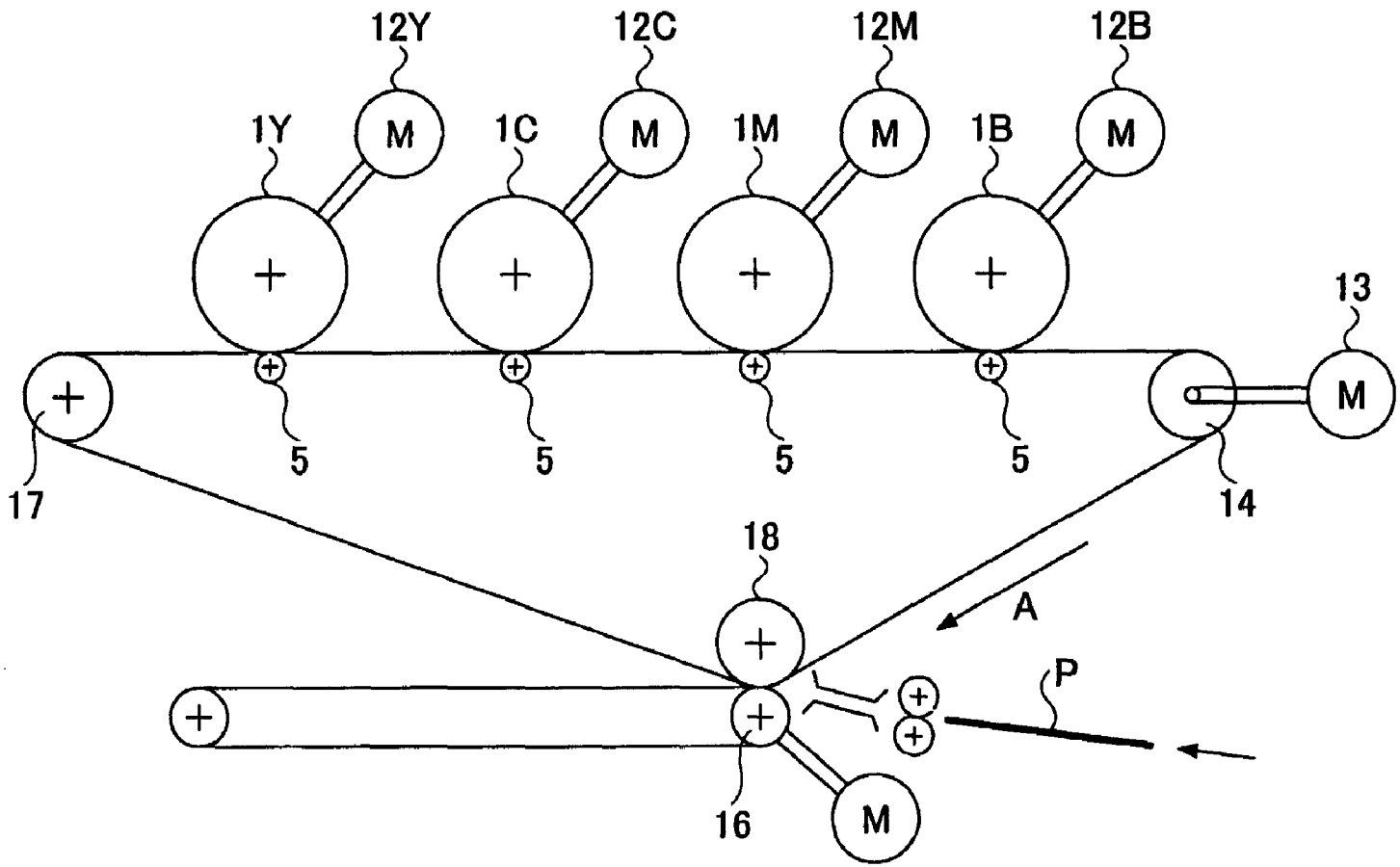
FIG. 2 is a schematic diagram of an image forming and reproducing system used in the image forming and reproducing apparatus according to an embodiment of the invention.
Figure 3:
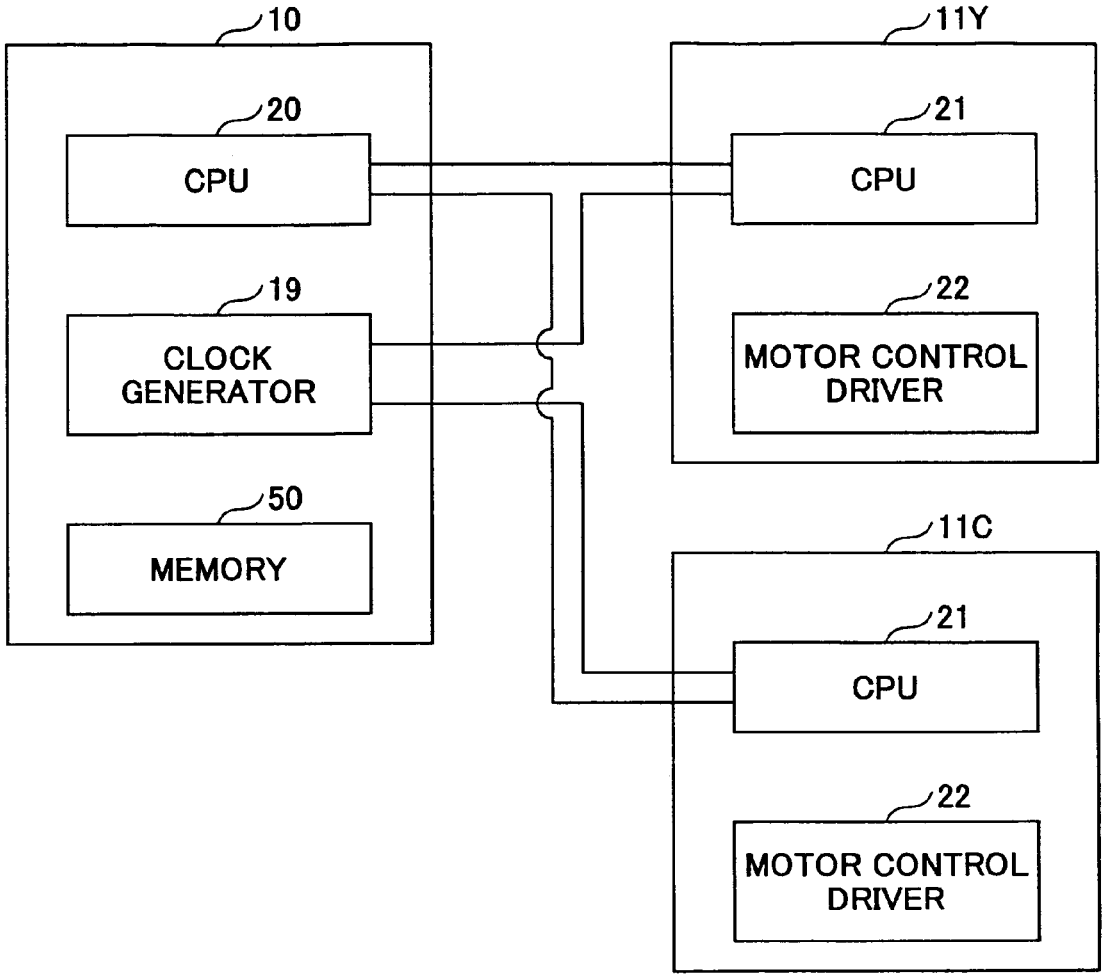
FIG. 3 is a block diagram for explaining motor control for the image forming and reproducing apparatus according to an embodiment of the invention.

FIG. 1 illustrates a control system and FIG. 2 illustrates an image forming and reproducing system of an image forming and reproducing apparatus according to an embodiment of the invention. FIG. 3 is a block diagram used to explain the motor control for the image forming and reproducing apparatus.

The image forming and reproducing apparatus has multiple photosensitive bodies 1Y, 1C, 1M and 1B (referred to simply as "photosensitive bodies 1" when not specified), and associated development units 2Y, 2C, 2M and 2B (referred to simply as "development units 2" when not specified). This apparatus shown in FIG. 1 is a tandem type electrophotographic printing apparatus (a color copier or a color printer), in which a single-color toner image is formed on each of the photosensitive bodies 1. The toner images on the photosensitive bodies 1 are successively transferred onto an intermediate transfer belt 3 to form a combined color image, which image is then transferred onto a transfer sheet at once. The arrangement of the photosensitive bodies 1Y, 1C, 1M and 1B of the respective colors-is not limited to the examples shown in FIG. 1 and FIG. 2, and it may be appropriately changed.

The photosensitive bodies 1Y, 1C, 1M and 1B in this example are of a drum type, and transfer rollers 5 are provided corresponding to the respective photosensitive drums 1 via the rotating intermediate transfer belt 3. The photosensitive drums 1 are image carriers rotated independently, on which different colors of images are formed, which images are transferred onto the intermediate transfer belt 3 at the corresponding transfer positions. The transfer rollers 5 assure the image transfer from the photosensitive drums 1 onto the intermediate belt 3 at the respective positions.

Around the photosensitive drum 1 are provided a development unit 2, a charging unit 6, a cleaning unit 7, and a neutralization unit 8. A laser beam is emitted from a laser writing unit 4 corresponding to each of the colors, and it scans on the associated photosensitive drum 1 according to pixel signals to form an electrostatic latent image on it. Since the color image forming operations of the apparatus are the same as those in the conventional image forming and reproducing apparatuses, and explanation for them is omitted.

The image forming and reproducing apparatus of the embodiment has an image forming and reproducing controller 10 that functions as rotation speed controller, which controller may be constructed as a microcomputer. The image forming and reproducing controller 10 causes multiple (four in this example) images on the photosensitive drums 1 to be transferred onto the intermediate transfer belt 3 so as to be superposed on each other. When misalignment occurs among the superposed images, the controller 10 adjusts the rotation speed of the photosensitive drums 1 so as to cancel the misalignment according to the amount of the positional offset of the images in the rotating direction with respect to that formed on the reference photosensitive drum 1, and maintains the adjusted speed.

The image forming and reproducing controller 10 outputs control signals to motor controllers 11Y, 11C, 11M and 11B in order to drive associated motors 12Y, 12C, 12M and 12B, respectively.

The photosensitive drum 1Y is rotated by motor 12Y whose rotation is controlled by motor controller 11Y. Similarly, the photosensitive drums 1C, 1M, and 1B are rotated by motors 12C, 12M, and 12B, respectively, whose rotations are controlled by motor controllers 11C, 11M, and 11B, respectively.

The motor controllers 11Y, 11C, 11M, and 11B are connected to the image forming and reproducing controller 10. Between the image forming and reproducing controller 10 and each of the motor controllers 11 is carried out signal transmission including at least motor ON/OFF signals and rotational direction indicating signals (both of which are output from CPU 20 shown in FIG. 3), as well as speed control signals. Each of the motor controllers is also connected to a power source and ground, thereby allowing the photosensitive drums to be driven by different motors independently from each other. The intermediate transfer belt 3 is rotated by a separate motor 13, via a drive roller 14, in direction A. The motor 13 is controlled by an intermediate transfer motor controller 15.

The toner images of yellow, cyan, magenta, and black formed on the associated photosensitive drums 1 are rotated in the direction indicated by the curved arrows and successively transferred by means of transfer rollers 5 onto the intermediate transfer belt 3 at the associated transfer positions (the primary transfer section) so as to be superposed on each other. If there is any misalignment arising in a color image with respect to the other color images, the rotation speed of the photosensitive drum 1 for that color image is changed so as to adjust the time required for the toner image formed on that photosensitive drum 1 to reach the primary transfer section (at which the transfer roller 5 is located).

The intermediate transfer belt 3 extends around the drive roller 14 and two tension rollers 17 and 18 (see FIG. 2), and it rotates in the direction A. The combined image formed on the intermediate transfer belt 3 by superposing the color images on each other is transported to the secondary transfer position, at which the combined image is transferred onto transfer paper P by secondary transfer unit 16.

In this arrangement, even if the color images are offset from each other at the primary transfer position in the rotating direction of the photosensitive drum 1, due to variation in assembling of the photosensitive drums 1, or even if the distance from the exposure position of the laser bema emitted from the laser writing unit 4 corresponding to the color to the first transfer position varies among the photosensitive drums, time required for the image formed at the exposure position (Pr shown in FIG. 4) on the photosensitive drum 1 to reach the first transfer position (one of P1-P4 shown in FIG. 4) can be controlled by adjusting the rotation speed of each of the motors 12Y, 12C, 12M, and 12B. In this manner, positional offset of the color images forming a combined image can be corrected in the image forming and reproducing apparatus of the embodiment.

Misalignment of the color images in the superposed (or combined) image is recognized based on the output from the image misalignment detection means. Any known structure can be used as the image misalignment detection means. For example, a registration pattern for detecting color image misalignment is formed on the intermediate transfer belt 3 prior to the actual image formation, and the patterns of respective colors are detected using multiple sensors. The amount of misalignment may be calculated from the detection result.

Figure 4:
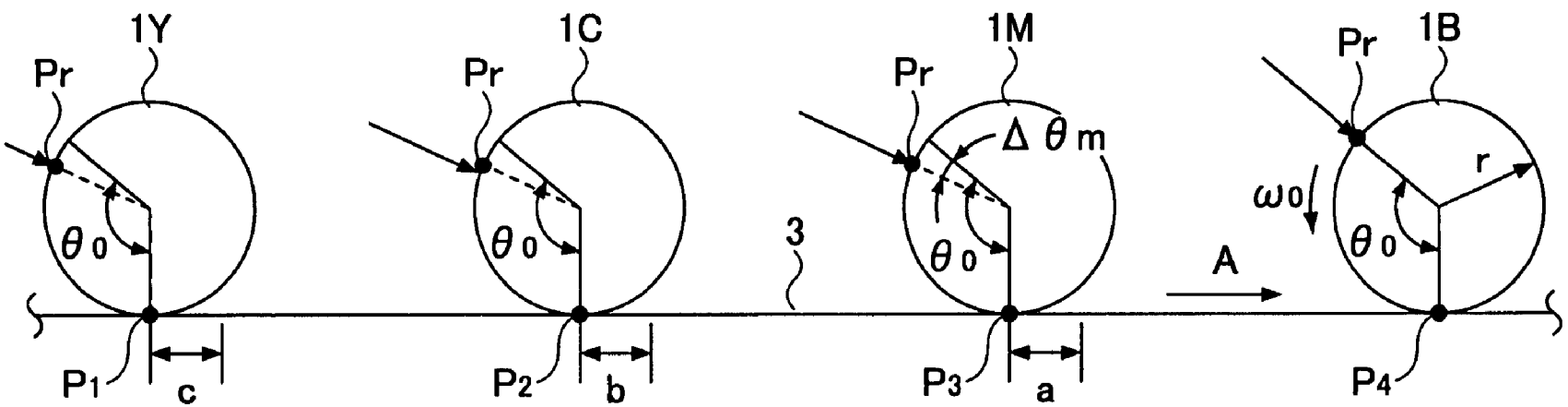
FIG.4 is a schematic diagram for explaining positional offset of magenta, cyan, and yellow images at the corresponding transfer positions, with respect to the black image.

Next, detailed explanation is made of correction of positional offset of color images at the primary transfer position by adjusting the photosensitive drums of the respective colors using the black drum as the reference drum, in conjunction with FIG. 4.

In this embodiment, one of the photosensitive drums has a fixed rotation speed without being changed, which drum is photosensitive drum 1B for forming a black image.

FIG. 4 illustrates positional offset of the magenta, cyan, and yellow images at the associated transfer position with respect to reference position of the black image. The rotation speeds of the photosensitive drums 1Y, 1C, and 1M are adjusted corresponding to the positional offset of the respective color images from the black one, so as to align the color images at the associated transfer positions P1, P2, and P3 in the slow scan direction (in the direction A of the intermediate transfer belt 3). In this example, the order of image transfer onto the intermediate transfer belt 3 is yellow (Y), cyan (C), Magenta (M), and black (B).

The rotation speeds of the photosensitive drums 1Y, 1C, 1M, and 1B are controlled by the image forming and reproducing controller 10, as illustrated in FIG.1. The image forming and reproducing controller 10 outputs rotation speed signals based on the clock frequencies generated by the clock generator 19 to the CPU 21 of each of the motor controllers 11Y, 11C, 11M, and 11B (motor controllers 11M and 11B are not shown in FIG. 3). According to the received signals, the motor control drivers 22 drive the associated motors 12Y, 12C, 12M and 12B.

Each of the motor controllers 11 counts the rotation speed signal at the internal clock of the CPU 21, thereby recognizing the speed information. The internal clock of the CPU 21 has to be sufficiently large, as compared with the rotation speed clock. In order to perform rotation speed control using a rotation speed signal based on a clock frequency, the clock frequency output from the image forming and reproducing controller 10 has to be highly accurate. An advantage that the rotation speed signal is supplied by a single signal line is acquired. In this manner, when the image forming and reproducing controller 10 is configured to change the rotation speed signal linearly under the control of clock frequency, the rotation speed of each motor can be changed substantially linearlly. If the motor control is phase-locked loop (PLL) control, the motor controllers 11Y, 11C, 11M, and 11B do not have to be CPUs.

In the example shown in FIG. 4, the position of the magenta image is offset toward the advanced position, with respect to the reference position of the black image, in the traveling direction (indicated by the arrow A) of the intermediate transfer belt 3. If the angle between the writing position (exposure position) Pr of the black image on the photosensitive drum 1B to the transfer position P4 is θ0, and if the angular velocity of the photosensitive drum 1B is ω0, then time t0 required for the black image formed at position Pr to move to transfer position P4 is expressed as $$t0=\theta 0/\omega 0. \quad (1)$$

If the writing position of the magenta photosensitive drum 1M is offset by Δ θm (radian) from the reference position of the black photosensitive drum 1B, due to assembling error or other factors, in the rotating direction as illustrated in FIG. 4, and if the photosensitive drums 1M and 1B rotate at the same revolution rate, then misalignment "a" is produced between the black image and the magenta image on the intermediate transfer belt 3. The misalignment "a" is expressed as $$a=r*\Delta\theta m \quad (2)$$

where r denotes the radius of the photosensitive drums 1.

Under the assumption that the photosensitive drums 1M and 1B rotate at the same rotation speed, time tm required for the image formed at writing position Pr on the magenta photosensitive drum 1M to move to the transfer position P3 is expressed as $$tm=(\theta 0-\Delta\theta m)/\omega 0. \quad (3)$$

If tm and t0 are equal to each other, misalignment between the black image and the magenta image in the slow scan direction does not occur. Accordingly, if the rotation speed of the photosensitive drum 1M is controlled so that tm becomes equal to t0 (tm=t0), then the positional offset of the magenta image with respect to the black image in the slow scan direction can be corrected.

In the embodiment, the rotation speeds of the photosensitive drums 1Y, 1C, and 1M are adjusted such that time required for the respective images formed on these drums to move from their writing positions to the transfer positions P1, P2, and P3, respectively, become equal to time required for the black image on the photosensitive drum 1B to move from its writing position Pr to the transfer position p4. In other words, the rotation speeds of the photosensitive drums 1Y, 1C, and 1M are controlled such that time required from exposure for image writing to image transfer onto the intermediate belt 3 becomes constant among yellow, cyan, magenta, and black images.

First, angular velocity ωm that makes tm equal to t0 (tm=t0) is determined.

$$t0=\theta 0/\omega 0=tm=(\theta 0-\Delta\theta m)/\omega m$$

$$\theta 0*\ \omega m=(\theta 0-\Delta\theta m)$$

$$\omega m=\{\omega 0*(\theta 0-\Delta\theta m)\}/\theta 0. \quad (4)$$

Since Equation (2) defining a=r/Δθm is rewritten as Δθm=a/r, $$\omega m=(1-a/r*\ \theta 0)*\ \omega 0 \quad (5)$$

holds.

In the embodiment, the rotation speeds of the motors 12Y, 12C, 12M, and 12B are controlled by the motor controllers 11Y, 11C, 11M, and 11B, respectively, based on the clock frequencies supplied from the image forming and reproducing controller 10. If the clock frequency of the motor speed signal for the reference photosensitive drum 1B is f0, and if the clock frequency of the motor speed signal from the magenta photosensitive drum 1M is fm, then fm is expressed as $$fm=(1-a/r*\ \theta 0)/f0. \quad (6)$$

The same process applies to the cyan photosensitive drum 1C and the yellow photosensitive drum 1Y. The clock frequencies fc and fy of the motor speed signals for the photosensitive drums 1C and 1Y are expressed as $$fc=(1-b/r*\ \theta 0)/f0, \text{ and}$$

$$fy=(1-c/r*\ \theta 0)/f0, \quad (7)$$

respectively, where "b" denotes the amount of misalignment of the cyan image with respect to the black image at transfer position P2, and "c" denotes the amount of misalignment of the yellow image with respect to the black image at transfer position p1. The black image is superposed on the yellow and cyan images at transfer position P4.

In the above-described example, the magenta, cyan, and yellow images are offset from the black image in the advancing direction. If the transferred positions of these images are behind the black image, similar relations stand, that is, $$t0=\theta 0/\omega 0, \quad (1)$$

$$a=r*\ \Delta\theta m, \text{ and} \quad (2)$$

$$tm=(\theta 0+\Delta\theta m)/\omega 0. \quad (3)'$$

If tm=t0, the black image and the magenta image align with each other at transfer position P2. The angular velocity ωm of the photosensitive drum 1M that satisfies tm=t0 is determined as follows.

$$t0=\theta 0/\omega 0=tm=(\theta 0+\Delta\theta m)/\omega m$$

$$\theta 0*\ \omega m=\omega 0(\theta 0+\Delta\theta m)$$

$$\omega m=\{\omega 0*\ (\theta 0+\Delta\theta m)\}/\theta 0. \quad (4)'$$

Since Equation (2) defining a=r/Δθm is rewritten as Δθm=a/r, $$\omega m=(1+a/r*\ \theta 0)*\ \omega 0 \quad (5)'$$

holds.

The clock frequency fm of the motor speed signal for the magenta photosensitive drum 1M is expressed as $$fm=(1+a/r*\ \theta 0)/f0. \quad (6)'$$

The same process applies to the cyan photosensitive drum 1C and the yellow photosensitive drum 1Y, and the clock frequencies fc and fy of the motor speed signals for the photosensitive drums 1C and 1Y are expressed as $$fc=(1+b/r*\ \theta 0)/f0, \text{ and}$$

$$fy=(1+c/r*\ \theta 0)/f0. \quad (7)'$$

By changing the clock frequency (corresponding to the motor revolution speed), the transfer timings of the stations for forming color images other than black can be controlled so as to be conform to the transfer timing of the reference station for the black image at precision within a dot. The timing adjusting precision of each station with respect to the reference black station depends on the resolution of the motor revolution speed. With this arrangement, misalignment among color images can be reduced efficiently.

For example, if r=0.03 m, θ0=2.827433 radians, f0=1000 Hz stand, and if the image on a photosensitive drum to be corrected is behind the black image by 10 μm, then the rotation speed signal from that photosensitive drum is set to 1000.118 Hz.

In this manner, in the embodiment, the black photosensitive drum 1B used as the reference drum is rotated at a fixed speed, and the rotation speeds of the other photosensitive drums are adjusted so as to conform to that of the black photosensitive drum 1B, and the rotation speed correction system can be simplified.

The above-described color image misalignment correction based on adjustment of the rotation speed of the associated photosensitive drum may be performed by the microcomputer of the image forming and reproducing controller 10 illustrated in FIG. 1. In this case, the microcomputer of the image forming and reproducing controller 10 carries out an image misalignment correction routine shown in FIG. 5 at prescribed timing. The image misalignment correction routine is executed, for example, when the power is turned on, when the number of sheets used in the printing operation reaches at or more than a prescribed value, or when the writing temperature falls to or below a prescribed temperature.

In the operation flow, it is determined in step S1 whether there is misalignment produced among color images. If there is no misalignment generated (NO in S1), the process proceeds to step S6, and the correction routine is terminated, while maintaining the current rotation speeds of all the photosensitive drums. If there is misalignment detected between color images (YES in S1), then the process proceeds to step S2, in which angular velocity ω to be corrected is calculated. In step S3, clock frequency f corresponding to the calculated angular velocity ω is determined.

Figures 10, 11:
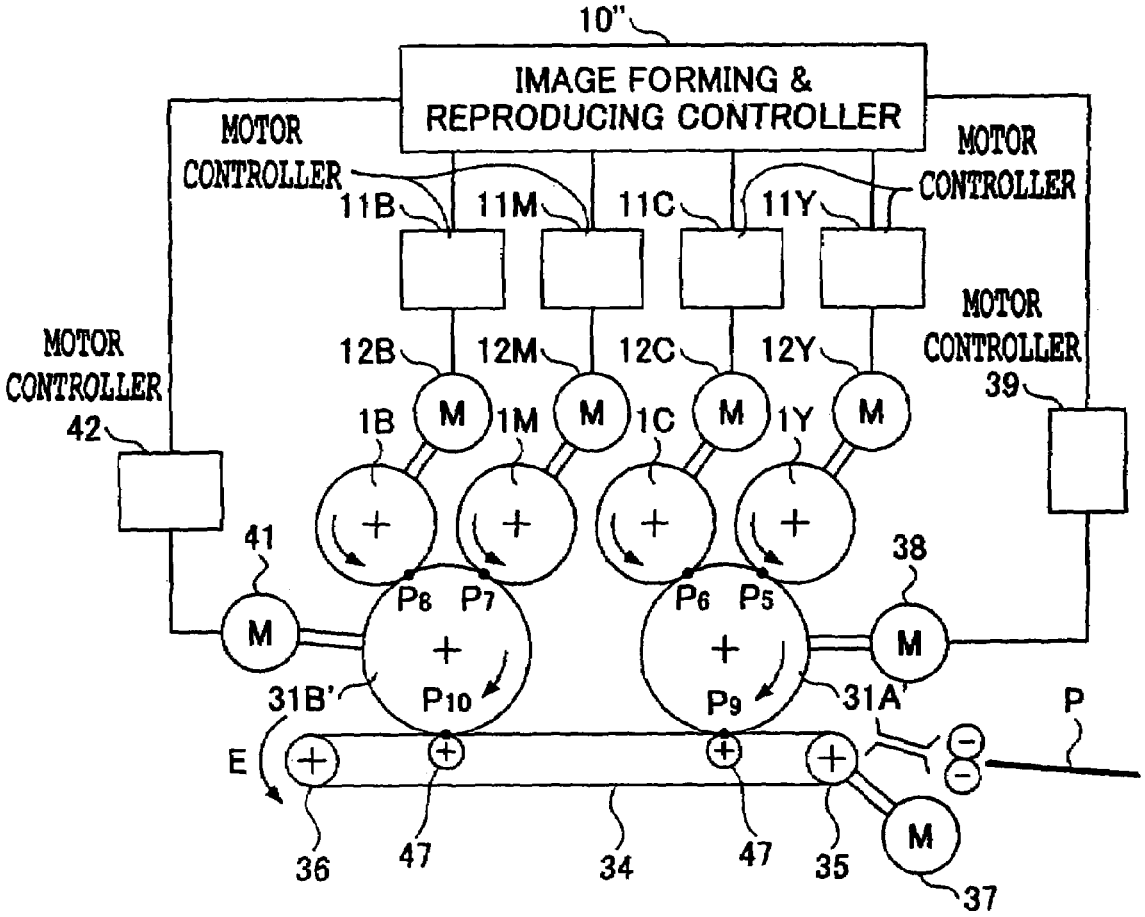
FIG. 10 is a schematic diagram of the image forming and reproducing system and its vicinities of a direct transfer type tandem image forming and reproducing apparatus having two intermediate transfer drums for transferring the carrying images directly onto a transfer sheet.
FIG. 11 is a table for managing motor controllers of the respective colors in association with angular velocities.

Then, in step S4, at least one of the angular velocity ω and the clock frequency f determined in steps S2 and S3, respectively, is stored in memory 50 of the image forming and reproducing controller 10, in association with the corresponding motor controller 11. FIG. 11 is an example of a table that stores angular velocities of the photosensitive drums in association with motor controllers 11.

In step S5, the clock frequency f stored in the memory 50 in S4 is read out, or alternatively, the clock frequency is calculated from angular velocity ω stored in the memory 50 in order to control the rotation speed of the motor for driving the photosensitive drum 1 of the misaligned color image to be corrected at the determined clock frequency f. Then, the routine is terminated.

Although, in the embodiment, the black photosensitive drum is selected as the reference photosensitive drum whose rotation speed is fixed during the image misalignment correction, any other photosensitive drum may be selected as the reference.

If the two or more color images are offset from the black image at the transfer positions, all the misaligned images are not necessarily offset in the same direction (that is, in the advancing direction or delaying direction) with respect to the black image. Some of the misaligned images may be advanced from the black image, while the other may be beyond the reference image. For example, the magenta and cyan images may be offset from the black image in the advancing direction, while the yellow image may be beyond the black image. The invention can be applied to such a case, regardless of the offset directions.

Figure 6:
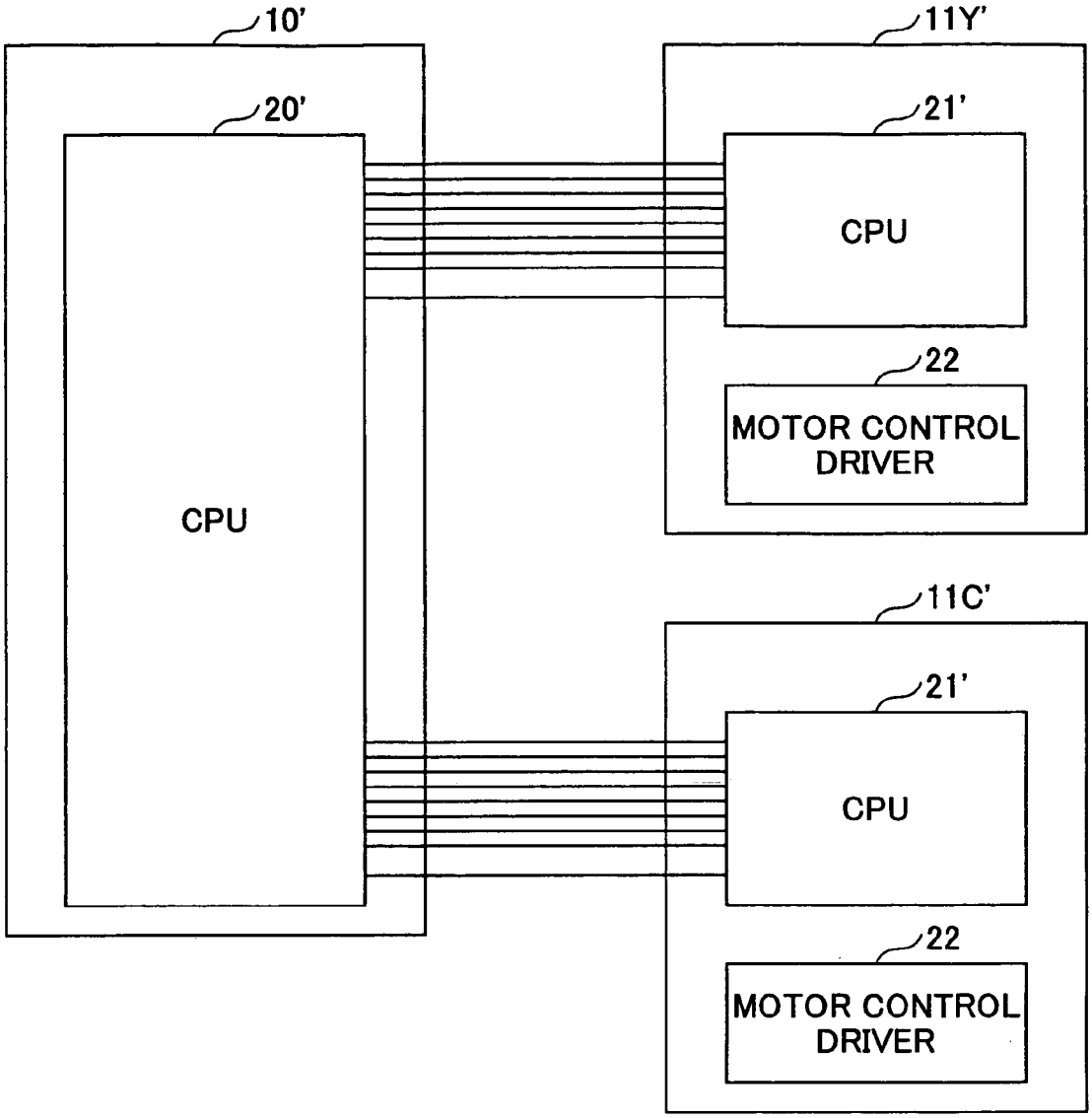
FIG. 6 is a block diagram of another example of a control system for controlling rotation speed of the motor for driving a photosensitive drum.

FIG. 6 is a block diagram illustrating another example of the control system performing rotation speed control for the photosensitive drum driving motors.

In this control system, the motor controllers 11Y', 11C', 11M', and 11B' (motor controllers 11M' and 11B' are not shown in FIG. 6) are configured to change the rotation speeds based on multiple data bits input from the CPU 20' of the image forming and reproducing controller 10'.

With this control system, the CPU 20' of the image forming and reproducing controller 10' outputs rotation speed signals to the CPU 21' of each of the motor controllers 11', via multiple data bit lines (8-bit lines in this example). This arrangement requires 8 bit lines per motor controller 11' for supplying the rotation speed signals.

In this case, the rotation speed changing range is limited to 256 levels; however, highly controlled precision is not required in the output signal, unlike the rotation speed control based on clock frequency of the previous example shown in FIG. 3. This arrangement is effective when the control range for changing the rotation speed is small.

In addition, the bus connection between the CPU 20' of the image forming and reproducing controller 10' and the CPU 21' of each motor controller 11' has anti-noise effect for reducing noise influence on the rotation speed signal for the motor propagating through the transmission line. Consequently, error operation can be prevented.

Figure 7:
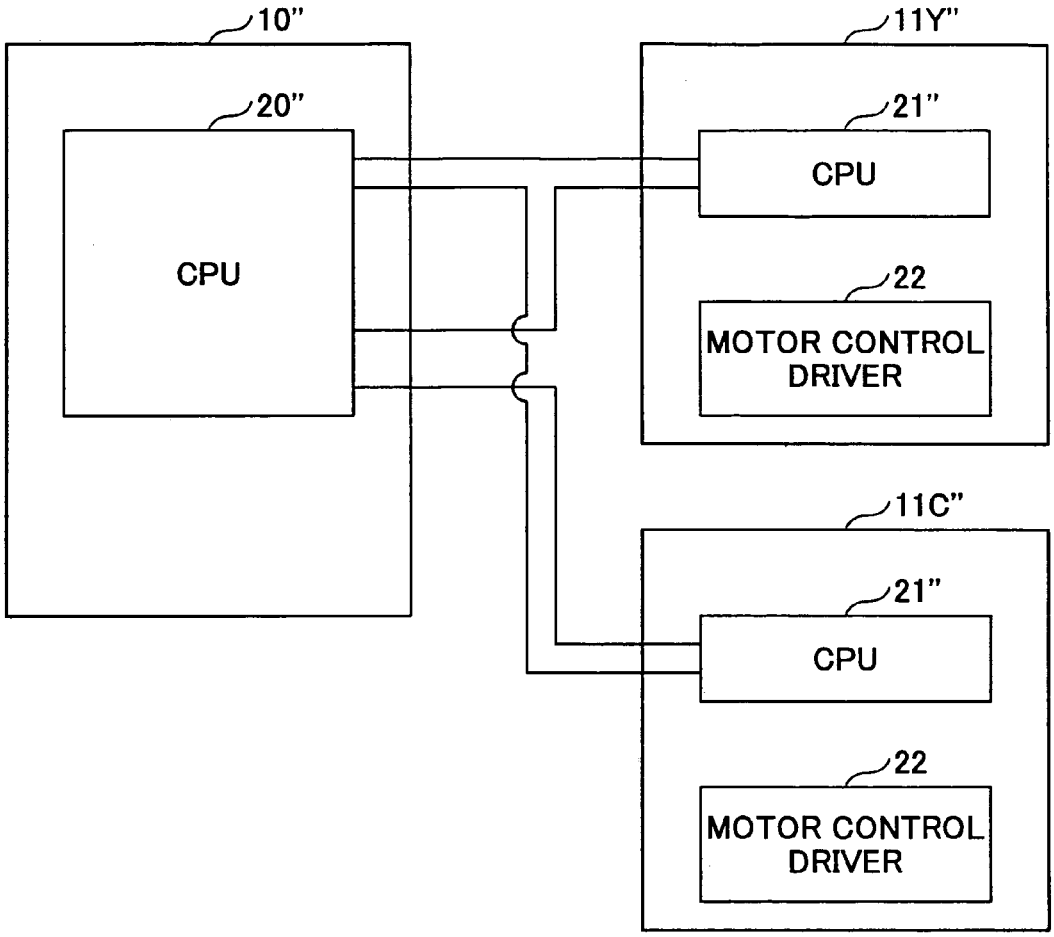
FIG. 7 is a block diagram of still another example of the control system for controlling rotation speed of the motor for driving a photosensitive drum.

FIG. 7 is a block diagram illustrating still another example of the control system for controlling the rotation speeds of the photosensitive drum driving motors.

In this control system, the motor controllers 11Y", 11C", 11M", and 11B" (motor controllers 11M" and 11B" are not shown in FIG. 7) are configured to change the rotation speeds based on serial data input from the CPU 20" of the image forming and reproducing controller 10".

The CPUs 21" of each of the motor controllers 11" is connected to the image forming and reproducing controller 10" via serial communication. Each of the CPUs 21" controls the rotation speed of the associated motor for driving the photosensitive drum based on the supplied serial data. By supplying the rotation speed signal by means of serial communication data, the anti-noise effect can be improved, as compared with rotation speed control using clock frequency.

By supplying the rotation speed signal as serial transmission data, the number of single transmission lines can be reduce greatly, as compared with transmission of parallel data, because the necessary signal is supplied via a single transmission line. If a harness is employed for electrical connection, the harness can be narrowed.

This arrangement may take time to adjust the rotation speed when changing the rotation speed linearly, as compared with the rotation speed control using clock frequency or multiple bit data lines illustrated in FIG. 3 or FIG. 6; however, it is still sufficiently effective in such a system that does not have to change the rotation speed very often during the operation.

Figure 8:
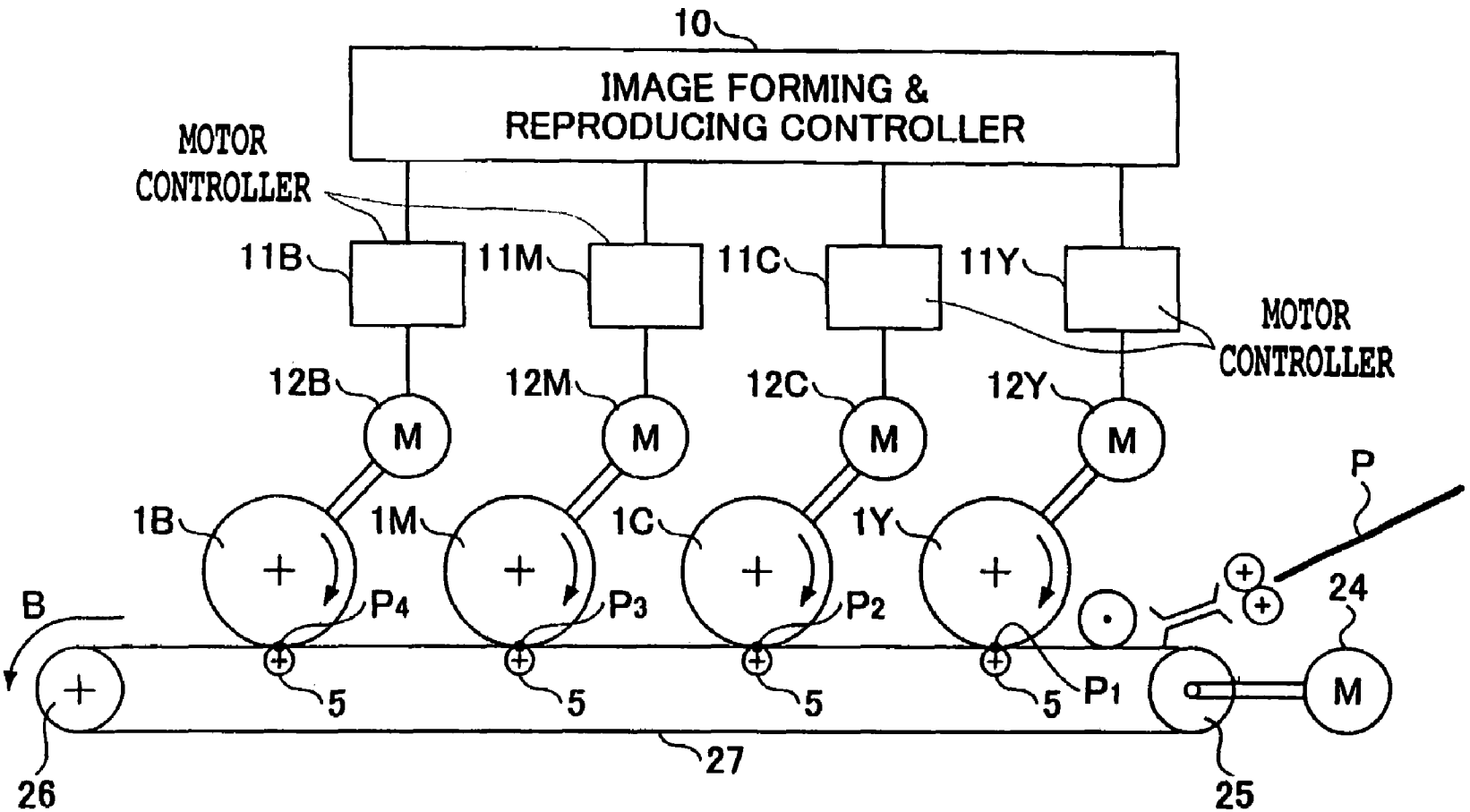
FIG. 8 is a schematic diagram of a direct transfer type image forming and reproducing system of an image forming and reproducing apparatus configured to transfer the images on the photosensitive drums directly onto recording paper.

FIG. 8 is a schematic diagram illustrating an image forming and reproducing system of a direct transfer type image forming and reproducing apparatus configured to transfer the color images on the photosensitive drums directly onto recording paper. This figure is similar to FIG. 2, and the components corresponding to those shown in FIG. 2 are labeled with the same symbols. The image forming and reproducing apparatus has photosensitive drums 1Y, 1C, 1M, and 1B which function as image carriers and are configured to rotate independently from each other. A transfer roller 5 is provided corresponding to each of the photosensitive drums 1 to allow the image on the associated photosensitive drum 1 to be transferred directly onto transfer paper P at prescribed transfer position. The transfer paper P is transported by a transport belt 27 extending between the driving roller 25 and the tension roller 26 and rotating in direction B.

The image forming and reproducing apparatus also has an image forming and reproducing controller 10 constructed as, for example, a microcomputer, which serves as rotation speed control means. If misalignment occurs among color images superposed on each other as a result of direct transfer onto the transfer paper P from the photosensitive drums, the image forming and reproducing controller 10 changes the rotation speeds of the photosensitive drums 1 so as to cancel the misalignment.

The image forming and reproducing controller 10 outputs signals to motor controllers 11Y, 11C, 11M, and 11B in order to separately drive the motors 12Y, 12C, 12M, and 12B, respectively.

Figure 5:
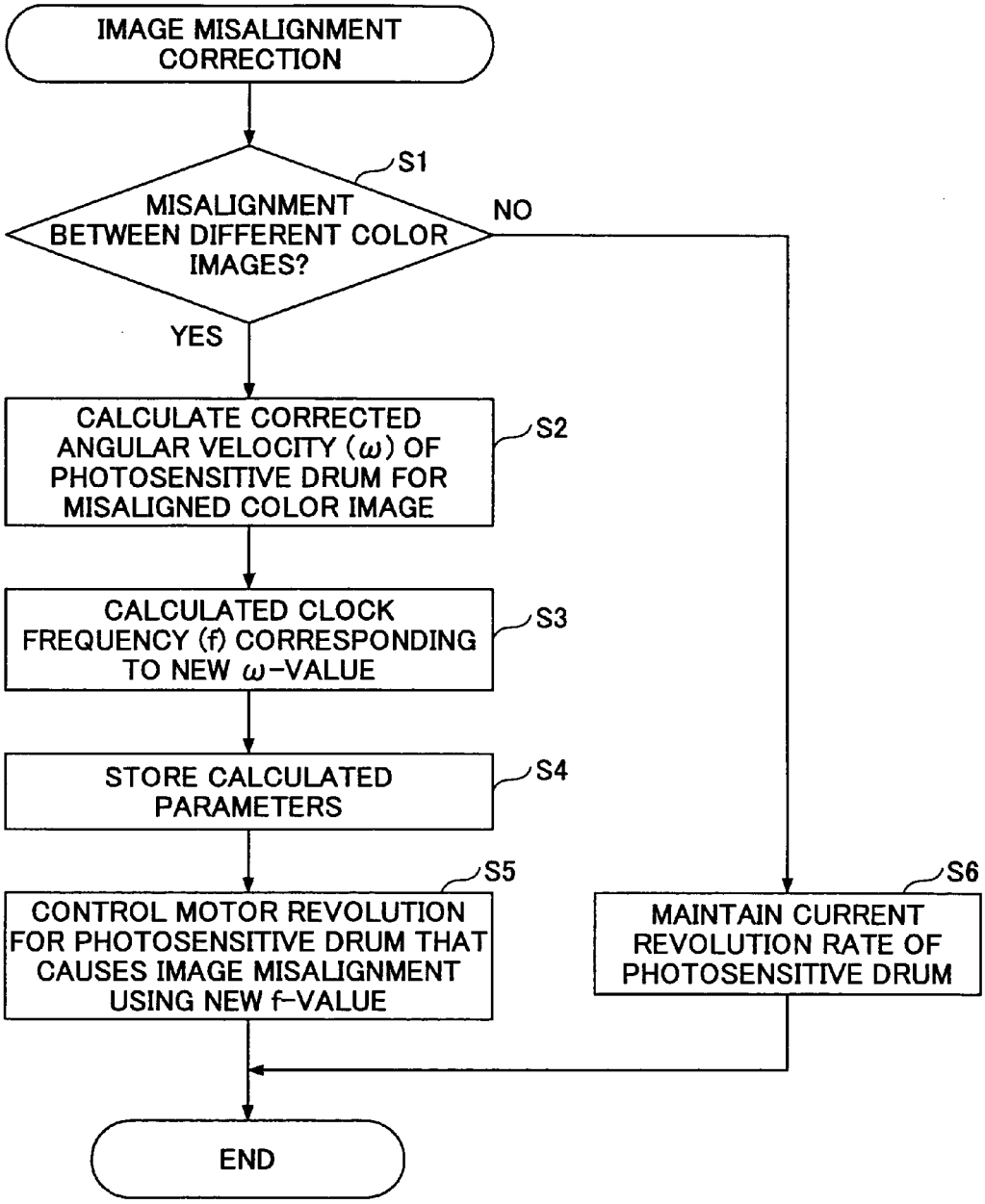
FIG. 5 is a flowchart showing the image misalignment correction routine carried out by the image forming and reproducing apparatus shown in FIG. 1.

In the manner similar to the indirect transfer type image forming and reproducing apparatus explained in conjunction with FIG. 1 through FIG. 5, misalignment of color images on the transfer paper P supported on the transport belt 27 and traveling in direction B is detected by appropriate image misalignment detection means. If any misalignment or positional offset is detected, image misalignment correction process shown in FIG. 5 is carried out. Namely, the rotation speed of the photosensitive drum 1 on which the misaligned image has been formed is changed, and time required for the toner image on that photosensitive drum 1 to reach the transfer position (P1-P4) is adjusted (or corrected) so as to cancel the misalignment having occurred on the transfer paper.

In this image forming and reproducing apparatus, the transfer timing of each station for forming and reproducing the associated color image can be adjusted accurately even for positional offset within a dot. Consequently, misalignment between color images can be corrected at high precision.

Detection of misalignment between superposed images can be performed using image misalignment detection means similar to that explained in the previous embodiment in conjunction with FIG. 1 through FIG. 6.

Correction for image misalignment is performed using a registration pattern for detecting color misalignment, prior to actual image forming and reproducing operation. The registration pattern may be transferred directly onto the transport belt 27. In this case, after the misalignment between color images is detected, the transferred color images may be erased by a belt cleaning unit (not shown). Alternatively, the registration pattern may be transferred onto transfer paper transported by the transfer belt 27. In this case, the test pattern is discarded after detection of image misalignment between colors.

Figure 9:
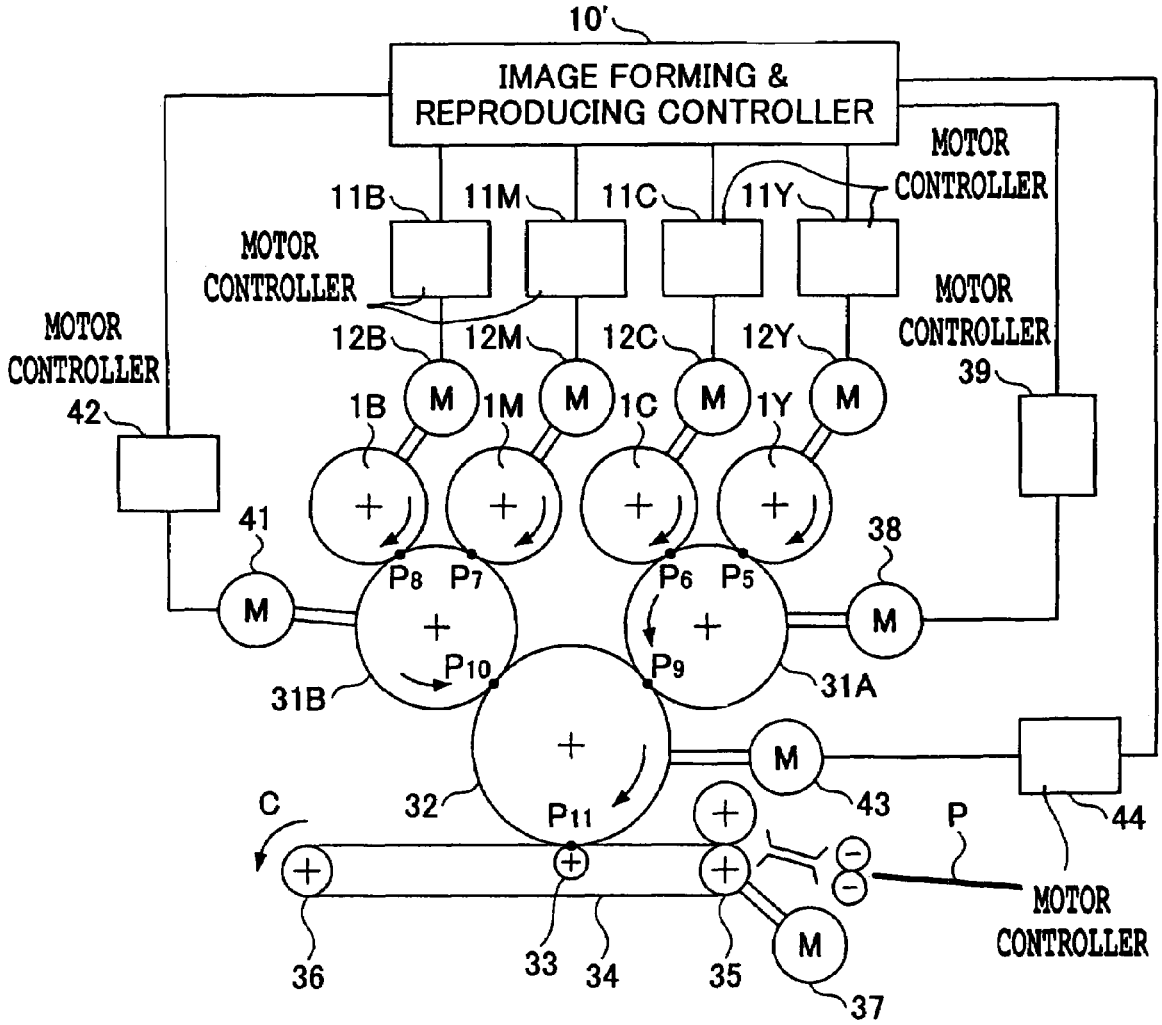
FIG. 9 is a schematic diagram illustrating the image forming and reproducing system and its vicinities of a tandem image forming and reproducing apparatus having first and second intermediate transfer drums.

FIG. 9 is a schematic diagram illustrating an image forming and reproducing unit and its vicinity of a tandem type image forming and reproducing apparatus having first and second intermediate transfer drums.

The tandem type image forming and reproducing apparatus has photosensitive drums 1Y, 1C, 1M, and 1B, which drums function as image carriers on which yellow, cyan, magenta, and black images are formed, respectively, and are configured to rotate independently from each other. Two first intermediate transfer drums 31A and 31B are provided so as to rotate independently of each other. The toner images formed on the photosensitive drums 1Y and 1C are transferred onto one of the first intermediate transfer drums (for example, 31A) at primary transfer positions P5 and P6, and superposed one on the other. The toner images formed on the photosensitive drums 1M and 1B are transferred onto the other first intermediate transfer drum (for example, 31B) at primary transfer positions p7 and p8 and superposed one on the other.

The combined images superposed on each of the first intermediate transfer drums 31A and 31B are further transferred onto the second intermediate transfer drum 32 at the corresponding secondary transfer positions P9 and P10, thereby superposing the two-color images one on the other. The combined image on the second intermediate transfer drum 32 is transferred onto transfer paper P at the tertiary transfer position p11 by means of a transfer roller 33. The transfer paper P is transported by a transport belt 34 that rotates in direction C indicated by the arrow in FIG. 9. The transport belt 34 extends between a drive roller 35 and a tension roller 36. The drive roller 35 is rotated by a drive motor 37, thereby feeding the transport belt 34 in direction C.

The photosensitive drum 1Y is rotated by motor 12Y, and its rotation is controlled by motor controller 11Y. The photosensitive drum 1C is rotated by motor 12C, and its rotation is controlled by motor controller 11C. The photosensitive drum 1M is rotated by motor 12M, and its rotation is controlled by motor controller 11M. The photosensitive drum 1B is rotated by motor 12B, and its rotation is controlled by motor controller 11B.

The first intermediate transfer drum 31A is rotated by drive motor 38 whose rotation is controlled by motor controller 39. The other first intermediate transfer drum 31B is rotated by drive motor 41 whose rotation is controlled by motor controller 42. The second intermediate transfer drum 32 is rotated by drive motor 43 whose rotation is controlled by motor controller 44.

If misalignment occurs in at least one of the combined images superposed on the two intermediate transfer drums 31A and 31B, that is, if misalignment occurs between the color images transferred from the photosensitive drums 1Y and 1C onto the intermediate transfer drum 31A and/or between the color images transferred from the photosensitive drums 1M and 1B onto the intermediate transfer drums 31B, then the rotation speeds of the photosensitive drums 1Y and 1C and/or the rotation speeds of the photosensitive drums 1M and 1B are adjusted so as to cancel the misalignment between yellow and cyan images and/or misalignment between magenta and black images. If misalignment occurs in the combined image superposed from the two first intermediate transfer drums 31A and 31B onto the second intermediate transfer drum 32, then the rotation speeds of the first intermediate transfer drums 31A and 31B are adjusted so as to cancel the image misalignment. The rotation speeds of the photosensitive drums 1, as well as the rotation speeds of the first and second intermediate transfer drums 31 and 32 are controlled by image forming and reproducing controller 10' that functions as rotation speed control means.

The image forming and reproducing controller 10' is connected to the motor controllers 11Y through 11B, as well as to the motor controllers 39, 42, and 44. At least motor ON/OFF signals, speed signals, and rotating direction signals are transmitted between them. Accordingly, the photosensitive drums 1Y through 1B and the first and second intermediate transfer drums 31 and 32 are rotated by different motors independently from each other.

The toner images formed on the photosensitive drums 1Y and 1C are moved in the directions indicated by the curved arrows in FIG. 9 toward the primary transfer positions P5 and P6, respectively, along with the drum rotation, and transferred onto the associated first intermediate transfer drum 31A at P5 and P6 so as to be superposed one on the other. The toner images formed on the photosensitive drums 1M and 1B are also moved in the directions indicated by the curved arrows toward the primary transfer positions p7 and p8 along with the drum rotation, and transferred onto the associated first intermediate transfer drum 31B at p7 and p8 so as to be superposed one on the other.

If the yellow image and the cyan image superposed on the first intermediate transfer drum 31A are offset from each other, the image forming and reproducing controller 10' controls the motor controllers 11Y and 11C to change the rotation speeds of the photosensitive drums 1Y and 1C so as to cancel the misalignment between the yellow image and the cyan image. Consequently, the misalignment between the yellow and cyan images can be corrected at a high precision within a dot.

Similarly, if the magenta image and the black image superposed on the first intermediate transfer drum 31B are offset from each other, the image forming and reproducing controller 10' controls the motor controllers 11M and 11B to change the rotation speeds of the photosensitive drums 1M and 1B so as to cancel the misalignment between the magenta image and the black image. Consequently, the misalignment between the magenta and black images can be corrected at a high precision within a dot.

Next, the combined image of yellow and cyan transferred onto the first intermediate transfer drum 31A is moved to the secondary transfer position P9 along with the drum rotation in the arrowed direction in FIG. 9, and transferred onto the second intermediate transfer drum 32. The combined image of magenta and black transferred onto the first intermediate transfer drum 31B is moved to the secondary transfer position P10 along with the drum rotation in the arrowed direction in FIG. 9, and transferred onto the second intermediate transfer drum 32 so as to be superposed on the Y-C combined image. Consequently, a combined image of the four colors is formed on the second intermediate transfer drum 32 as the second intermediate transfer drum 32 rotates.

If there is any misalignment detected in the four-color combined image on the second intermediate transfer drum 32, the image forming and reproducing controller 10' controls the motor controllers 39 and 42 to change the rotation speeds of the first intermediate transfer drums 31A and 31B so as to cancel the image misalignment. It should be noted that if the rotation speed of an intermediate transfer drum is changed, the image writing timing of the laser writing timing should be changed. In addition, the registration position is also changed. With this arrangement, misalignment arising in the four-color combined image can be corrected at high precision within a dot.

The four-color combined image on the second intermediate transfer drum 32 is collectively transferred onto the transfer paper P at the tertiary transfer position p11 by means of a transfer roller 33.

Since the control process for controlling each of the motor controllers to change the rotation speed of the associated drum driving motor is the same as that explained in conjunction with FIG. 4 and FIG. 5, explanation for it is omitted here.

In addition, misalignment detection in the superposed images is carried out using the same misalignment detection means as that described in conjunction with FIG. 1 through FIG. 6. The misalignment correction is also carried out by forming a registration patter for detection of image misalignment prior to the actual image forming and reproducing operation, as in the previous embodiment.

Thus, in the tandem type image forming and reproducing apparatus that employs the first intermediate transfer drums 31A and 31B and the second intermediate transfer drum 32 to superpose two color images at each of the two primary transfer positions and superpose four color images into a single combined image at the secondary transfer position, misalignment among color images can be corrected at high precision within a dot.

FIG. 10 is a schematic diagram illustrating an image forming and reproducing unit and its vicinity of a tandem type image forming and reproducing apparatus having two intermediate transfer drums and configured to transfer the toner images on the two intermediate transfer drums directly onto transfer paper. The same components as those shown in FIG. 9 are denoted by the same symbols.

Unlike the tandem type image forming and reproducing apparatus of the previous example shown in FIG. 9, the image forming and reproducing apparatus shown in FIG. 10 is structured such that the Y-C combined image and the M-B combined image transferred onto the intermediate transfer drums 31A' and 31B' are transferred directly onto transfer paper P at the secondary transfer positions P9 and P10, respectively, by means of the associated transfer rollers 47. This image forming and reproducing apparatus differs from that shown in FIG. 9 only in the image forming and reproducing controller 10" that serves as rotation speed control means. If misalignment occurs in the combined image transferred from the two intermediate transfer drums 31A' and 31B' onto the transfer paper P, the rotation speeds of the two intermediate transfer drums 31A' and 31B' are adjusted so as to cancel the misalignment by the image forming and reproducing controller 10".

The control routine of the image forming and reproducing controller 10" is only partially different from that of the image forming and reproducing controller 10'.

If misalignment arises in at least one of the Y-C combined image transferred from the photosensitive drums 1Y and 1C onto the intermediate transfer drum 31A' and the M-B combined image transferred from the photosensitive drums 1M and 1B onto the other intermediate transfer drum 31B', then the image forming and reproducing controller 10" controls the rotation speeds of the photosensitive drums 1Y and 1C corresponding to the intermediate transfer drum 31A' and/or the rotation speeds of the photosensitive drums 1M and 1B corresponding to the intermediate transfer drum 31B' so as to cancel the misalignment (Y-C offset and/or M-B offset). This structure is the same as that explained in conjunction with FIG. 9.

The image on the intermediate transfer drum 31A' is transferred onto the transfer paper P transported by the transport belt 34 in direction E in FIG. 10 by means of a transfer roller 47 at secondary transfer position P9. When the transport paper P reaches the other secondary transfer position P10, the image on the other intermediate transfer drum 31B' is transferred onto the transfer paper P so as to be superposed on the previously transferred image.

The transport belt 47 extends between a drive roller 35 and a tension roller 36, and rotates in direction E along with the rotation of the drive roller 35 driven by the driving motor 37.

The four photosensitive drums 1Y, 1C, 1M, and 1B are rotated independently of each other by motors 12Y, 12C, 12M, and 12B, respectively. The rotations of these motors are controlled by the motor controllers 11Y, 1C, 11M, and 11B, respectively, as in the image forming and reproducing apparatus illustrated in FIG. 9.

The toner images formed on the photosensitive drums 1Y and 1C are moved in the directions indicated by the curved arrows in FIG. 10 toward the primary transfer positions P5 and P6, respectively, along with the drum rotation, and transferred onto the associated intermediate transfer drum 31A' at P5 and P6 so as to be superposed one on the other. The toner images formed on the photosensitive drums 1M and 1B are also moved in the directions indicated by the curved arrows toward the primary transfer positions p7 and p8 along with the drum rotation, and transferred onto the associated intermediate transfer drum 31B' at p7 and p8 so as to be superposed one on the other.

If the yellow image and the cyan image superposed on the intermediate transfer drum 31A' are offset from each other, the image forming and reproducing controller 101" controls the motor controllers 11Y and 11C to change the rotation speeds of the photosensitive drums 1Y and 1C so as to cancel the misalignment between the yellow image and the cyan image. Consequently, the misalignment between the yellow and cyan images can be corrected at a high precision within a dot.

Similarly, if the magenta image and the black image superposed on the intermediate transfer drum 31B' are offset from each other, the image forming and reproducing controller 10" controls the motor controllers 11M and 11B to change the rotation speeds of the photosensitive drums 1M and 1B so as to cancel the misalignment between the magenta image and the black image. Consequently, the misalignment between the magenta and black images can be corrected at a high precision within a dot.

Next, the combined image of yellow and cyan transferred onto the intermediate transfer drum 31A' is moved to the secondary transfer position P9 along with the drum rotation in the arrowed direction in FIG. 10, and transferred onto the transfer paper P. The combined image of magenta and black transferred onto the intermediate transfer drum 31B' is moved to the secondary transfer position P10 along with the drum rotation in the arrowed direction in FIG. 10, and transferred onto the transfer paper P so as to be superposed on the Y-C combined image. Consequently, a combined image of the four colors is formed on the transfer paper P.

If there is any misalignment detected in the four-color combined image on the transfer paper P, the image forming and reproducing controller 10" controls the motor controllers 39 and 42 to change the rotation speeds of the intermediate transfer drums 31A' and 31B', respectively, so as to cancel the image misalignment. It should be noted that if the rotation speed of an intermediate transfer drum is changed, the image writing timing of the laser writing timing should be changed. In addition, the registration position is also changed. With this arrangement, misalignment arising in the four-color combined image can be corrected at high precision within a dot.

Since the routine for controlling each of the motor controllers so as to change the rotation speeds of the associated motors is the same as those explained in conjunction with FIG. 4 and FIG. 5, explanation for it is omitted.

Misalignment in the superposed images is detected using the detection means the same as that explained in the previous embodiments in conjunction with FIG. 1 through FIG. 6.

Correction for image misalignment is performed prior to the actual image forming and reproducing operation, as in the previous embodiments, using a registration pattern formed for the purpose of detection of misalignment. Such a registration pattern may be transferred directly onto the transport belt 34, and erased by a belt cleaning unit (not shown) after the detection. Alternatively, the pattern may be transferred onto transfer paper fed on the transport belt 34, and the paper may be discarded after the detection.

In the image forming and reproducing apparatus of each embodiment, other control means for controlling the image registration position or writing position of the laser writing unit (such as the laser writing unit 4 shown in FIG. 1) may be provided, in addition to the rotation speed control means. In this case, image misalignment can be corrected based on correcting the image registration position by controlling the writing positions of the laser writing units and by controlling the rotation speeds of the motors for driving the photosensitive drums.

With this arrangement, image misalignment is corrected on the dot-by-dot basis first by controlling the image writing position of the laser writing unit, and then, more subtle misalignment occurring within a dot can be corrected using the latter means by adjusting the rotation speed of the motor. Consequently, image misalignment can be corrected at high precision.

In this case, correction for the image registration position of the laser writing unit is performed on the line basis of the laser scanning in the slow scan direction. Then, further correction is made on the image registration position by changing the rotation speed of the motor at precision within a step size between adjacent lines.

It is preferable for the image forming and reproducing apparatuses shown in FIG. 9 and FIG. 10 not to change the rotation speeds of the motors for driving the photosensitive drums and the intermediate transfer drums until at least a sheet of image reproduction is completed. This arrangement prevents correction for image misalignment from being performed in the middle of the image reproduction process on a sheet. With this arrangement, image misalignment correction is performed between paper feed timings in the continuing printing mode.

It is preferred to set the rotation speed changing range of each motor within plus or minus 1 percent (±1%) of the set values. With this arrangement, the ROM capacity required to control the motor revolution rates can be reduced.

In the image forming and reproducing apparatuses shown in FIG. 9 and FIG. 10, the rotation speed of each motor may be adjusted when the main power is turned on, the parts or components are replaced, or a predetermined number of image reproducing job are performed. In this case, misalignment between color images may be automatically measured and calculated after power on of the main power, replacement of parts, or a prescribed number of image reproduction jobs. If misalignment is detected, image misalignment can be corrected on a regular basis or at fixed intervals.

The present invention is not limited to the above-described examples, and many modification and substitution can be made by people with ordinary skill in the art without departing from the scope of the claims.

With the arrangement of the present invention, when misalignment occurs in superposed images, the rotation speeds of multiple image carriers are adjusted so as to cancel the misalignment. The initial misalignment among color images caused by error in distance between photosensitive drums, or error in parts precision or assembling accuracy of the image writing unit, can be corrected in a single operation. Since the rotation speeds of the rotating image carriers are controlled independently from each other, subtle misalignment, such as within-a-dot offset, in a superposed image can be corrected precisely.

The present invention can be applied widely to full-color image forming and reproducing apparatuses having multiple image carriers rotatable independently from each other and bearing different colors of images.

This patent application is based on and claims the benefit of the earlier filing date of Japanese Patent Application No. 2004-195493 filed Jul. 1, 2004, and No. 2005-166978 filed Jun. 7, 2005, entire contents of which are hereby incorporated by reference.

What is claimed is:

1. An image forming and reproducing apparatus configured to transfer images formed on a plurality of rotatable image carriers onto a transfer member at associated transfer positions, the apparatus comprising:

a rotation speed controller configured to control rotation speeds of the image carriers such that times required for the images formed at exposure positions of the image carriers to reach the associated transfer positions agree with each other among the image carriers when superposing the images one on the other on the transfer member.

2. The image forming and reproducing apparatus of claim 1, wherein the rotation speed controller controls the rotation speeds such that the rotation speed of one of the image carriers is fixed, and that the rotation speeds of the other image carriers become equal to the fixed rotation speed of said one of the image carriers.

3. The image forming and reproducing apparatus of claim 1, wherein the rotation speed controller changes the rotation speeds of the image carriers from initial set values such that times required for the images formed on the exposure positions of the image carriers to reach the associated transfer positions agree with each other among the image carriers.

4. The image forming and reproducing apparatus of claim 1, wherein the time required for each of the images formed on the exposure positions of the image carriers to reach the associated transfer position is obtained by dividing an angle between the exposure position on the image carrier and transfer position by an angular velocity of that image carrier.

5. The image forming and reproducing apparatus of claim 4, wherein the rotation speed controller controls such that a time t calculated by dividing an angle θ between the exposure position on each of said other image carriers and the transfer position by an angular velocity ω of this image carrier, becomes equal to time t0 calculated by dividing an angle θ0 between the exposure position on said one of image carriers and the transfer position by an angular velocity ω0 of said one of the image carriers.

6. The image forming and reproducing apparatus of claim 5, wherein the rotation speed controller includes:

a plurality of driving sources, each configured to drive one of the image carriers;

a plurality of driving source controllers, each configured to control the rotation speed of one of the image carriers driven by the associated driving source; and an image forming and reproducing controller configured to supply the driving source controllers with rotation speed instructions for the associated image carriers such that times required for the images formed at the exposure positions on the image carriers to reach the transfer positions agree with each other among image carriers.

7. The image forming and reproducing apparatus of claim 6, wherein the image forming and reproducing controller has storage means that stores at least one of the angular velocity and a clock frequency of each of the image carriers as a parameter for controlling the rotation speed of each of the image carriers.

8. The image forming and reproducing apparatus of claim 7, wherein the image forming and reproducing controller supplies the parameter for controlling the rotation speed of each of the image carriers to the associated driving source controller using the clock frequency.

9. The image forming and reproducing apparatus of claim 7, wherein the image forming and reproducing controller supplies the parameter for controlling the rotation speed of each of the image carriers to the associated driving source controllers using parallel data bits.

10. The image forming and reproducing apparatus of claim 7, wherein the image forming and reproducing controller supplies the parameter for controlling the rotation speed of each of the image carriers to the associated driving source controllers using a serial data bus.

11. The image forming and reproducing apparatus of claim 1, wherein the rotation speed controller sets the rotation speeds of the image carriers such that the times required for the images formed at the exposure positions on the image carriers to reach the associated transfer positions agree with each other among the image carriers when the apparatus is powered on, processing amount of the apparatus reaches a prescribed level, or operational environment satisfies a prescribed condition.

12. The image forming and reproducing apparatus of claim 1, wherein the transfer member is a transfer belt.

13. The image forming and reproducing apparatus of claim 1, wherein the transfer member is a transfer roller.

14. The image forming and reproducing apparatus of claim 1, wherein the transfer member is transfer paper.

15. An image transferring method for transferring images formed on a plurality of image carriers at associated transfer positions onto a transfer member, comprising the steps of:

acquiring rotation speed information for the image carriers, the rotation speed information being configured so as to bring times required for the images formed at exposure positions on the image carriers to reach the transfer positions in agreement with each other among image carriers; and controlling the rotation speeds of the image carriers based on the rotation speed information.

16. The method of claim 15, wherein the rotation speed information includes a fixed rotation speed assigned to one of the image carriers and a set of rotation speeds assigned to the other image carriers, the set of rotation speeds being determined such that the times required for the images on the other image carriers to reach the transfer positions agree with the time required for the image on said one of the image carriers to reach the associated transfer position.

17. The method of claim 15, wherein the rotation speed information includes a set of rotation speeds assigned to the respective image carriers, the set of rotation speeds being determined such that the times required for the images formed on the image carriers to reach the associated transfer positions agree with each other among the image carriers.

18. The method of claim 15, further comprising the steps of:

calculating the rotation speed of each of the image carriers such that times required for the images formed at the exposure positions on the image carriers to reach the associated transfer positions agree with each other among image carriers; and storing the calculated rotation speeds in storage means.

19. The method of claim 15, further comprising the step of:

transferring the images on the image carriers at the associated transfer positions onto a transfer belt under the controlled rotation speeds.

20. The method of claim 15, further comprising the step of:

transferring the images on the image carriers at the associated transfer positions onto a transfer roller under the controlled rotation speeds.

21. The method of claim 15, further comprising the step of:

transferring the images on the image carriers at the associated transfer positions onto transfer paper under the controlled rotation speeds.

* * * * *